US007362209B2

(12) United States Patent
Ohashi et al.

(10) Patent No.: US 7,362,209 B2
(45) Date of Patent: Apr. 22, 2008

(54) ZINC OXIDE RESISTOR AND ITS MANUFACTURING METHOD

(75) Inventors: Naoki Ohashi, Ibaraki (JP); Hajime Haneda, Ibaraki (JP); Isao Sakaguchi, Ibaraki (JP); Takeshi Ohgaki, Ibaraki (JP); Ken Kataoka, Ibaraki (JP)

(73) Assignee: National Institute for Materials Science, Tsukuba-shi (JP)

( * ) Notice: Subject to any disclaimer, the term of this patent is extended or adjusted under 35 U.S.C. 154(b) by 260 days.

(21) Appl. No.: 10/537,492

(22) PCT Filed: Dec. 2, 2003

(86) PCT No.: PCT/JP03/15448

§ 371 (c)(1),
(2), (4) Date: Dec. 14, 2005

(87) PCT Pub. No.: WO2004/051676

PCT Pub. Date: Jun. 17, 2004

(65) Prior Publication Data

US 2006/0164200 A1 Jul. 27, 2006

(30) Foreign Application Priority Data

Dec. 3, 2002 (JP) ..... 2002-350574

(51) Int. Cl.
*H01C 7/10* (2006.01)
*H01C 7/13* (2006.01)

(52) U.S. Cl. ..... 338/20; 338/22 R; 252/518; 252/521

(58) Field of Classification Search ..... 338/20–25; 29/610 R; 252/518, 521, 500, 519.5, 519.51, 252/520.52

See application file for complete search history.

(56) References Cited

U.S. PATENT DOCUMENTS 4,420,737 A * 12/1983 Miyoshi et al. ..... 338/21

(Continued)

FOREIGN PATENT DOCUMENTS

JP 2-219203 8/1990

(Continued)

OTHER PUBLICATIONS

M. Matsuoka, *Nonohmic Properties of Zinc Oxide Ceramics,* Japanese Journal of Applied Physics, vol. 10, No. 6, Jun. 1971, pp. 736-746.

(Continued)

*Primary Examiner*—K. Richard Lee
(74) *Attorney, Agent, or Firm*—Westerman, Hattori, Daniels & Adrian, LLP.

(57) ABSTRACT

Disclosed are a zinc oxide resistor structure, and methods of forming a glass layer and a resistor, which are required for producing the resistor structure. The zinc oxide resistor comprises zinc oxide grains and an oxide glass layer which contains bismuth and boron and intervenes between the zinc oxide grains. The oxide glass layer residing between the zinc oxide grains changes the electric properties between the grains to achieve a higher resistance and a non-ohmic characteristic of a voltage-dependent resistance value in the resistor. This non-ohmic characteristic can be applied, particularly, to a non-ohmic device to be compatible with a low-voltage operation. Differently from conventional resistors, the oxide glass layer intervening between the zinc oxide grains can achieve an enhanced mechanical strength of a junction in the device.

12 Claims, 6 Drawing Sheets

U.S. PATENT DOCUMENTS

| | | | | |
|---|---|---|---|---|
| 4,959,262 | A * | 9/1990 | Charles et al. | 428/329 |
| 5,770,113 | A * | 6/1998 | Iga et al. | 252/519.51 |
| 6,184,771 | B1 * | 2/2001 | Suzuki et al. | 338/21 |

FOREIGN PATENT DOCUMENTS

| | | |
|---|---|---|
| JP | 10-270214 A | 10/1998 |
| JP | 2000-228302 | 8/2000 |

OTHER PUBLICATIONS

A. Tanaka et al., *Evaluation of Single Grain Boundaries in ZnO: Rare-Earth Varistor by Micro-Electrodes,* Key Engineering Materials, vol. 157-158, CSJ Series—Publications of the Ceramic Society of Japan, vol. 1, 1999, pp. 235-240.

U. Schwing et al., *Model experiments describing the microcontact of ZnO varistors,* Journal of Applied Physics, 57 (12), Jun. 15, 1985, pp. 5372-5379.

N. Ohashi et al., *Synthesis of ZnO Bicrystals Doped with Co or Mn and Their Elecrical Properties,* Japanese Journal of Applied Physics, vol. 38, Part 1, No. 9A, Sep. 1999, pp. 5028-5032.

Y. Sato et al., *Current-Voltage Characteristics across* [0001]*Twist Boundaries in Zinc Oxide Bicrystals,* Journal of the American Ceramic Society, 85 (8), Aug. 2002, pp. 2142-2144.

* cited by examiner

ZINC OXIDE RESISTOR AND ITS MANUFACTURING METHOD

TECHNICAL FIELD

The present invention relates to a zinc oxide resistor, and more particularly a varistor device structure for protecting an electric/electronic circuit from surge voltages, and a production method thereof.

BACKGROUND ART

1. Typical Zinc Oxide Varsity

Generally, a zinc oxide varistor is provided as a polycrystalline zinc-oxide ceramics. Specifically, the zinc oxide varistor has been produced by mixing zinc oxide powder, transition metal oxide powder and bismuth oxide powder, and burning the mixture at a high temperature, to form a polycrystalline body with a structure in which a bismuth oxide or the like is segregated in the boundaries between zinc oxide grains each containing a transition metal oxide dissolved therein in the form of a solid solution (see, for example, the following Non-Patent Publication 1).

An appropriate additive makes it possible for the zinc oxide ceramics to exhibit a nonlinear current-voltage characteristic in which each grain boundary in the zinc oxide ceramics has an operating voltage of about 3 V (see, for example, the following Non-Patent Publication 2). That is, the operating voltage as one of varistor characteristics is generally determined by the number of grain boundaries. Specifically, as shown in FIG. 7, in a varistor device comprising two electrodes 2A, 2B provided at opposite end surfaces thereof and zinc oxide (ZnO) grains 1 residing therebetween, an overall operating voltage of the varistor device is determined by the product of the number of boundaries between the zinc oxide grains 1 and the operating voltage having the nonlinear current-voltage characteristic in each of the grain boundaries. Thus, the size of the zinc oxide grains 1 in the zinc oxide ceramics inherently contributes to the varistor characteristics.

The grain size of a ceramics depends on an additive and a burning temperature, and generally has a statistical distribution. This causes difficulties in setting the number of grains or each size of grains in a ceramics at a predetermined value. Therefore, the production of a low-voltage type varistor essentially requires a particular technique in addition to a simple burning technique for forming a ceramics. For example, a varistor device having an operating voltage of 30 KV is required to ensure 10000 grain boundaries each having an operating voltage of 3 V. In contrast, a varistor device having an operating voltage of 6 V means a ceramics which includes 2 grain boundaries each having an operating voltage of 3 V, or only 3 grains. That is, some technique for forming a ceramics having a small number of grain boundaries is required to produce a varistor operable at a low voltage.

2. Multilayer Varsity

As one technique for producing a varistor having a small number of grain boundaries, or a low operating voltage, there has been known multilayering (see, for example, the following Patent Publication 1). This technique comprises preparing a sheet-shaped compact to be burned as a ceramics, and forming alternate layers of a metal electrode layer and a zinc-oxide ceramics layer, as shown in FIG. 8(A). The intervening metal layer makes it possible to hinder the contact between the zinc oxide grains or reduce the number of grain boundaries so as to achieve a varistor having a low operating voltage.

However, as seen in the enlarged view of FIG. 8(A), while each of a grain boundary 1 and a grain boundary 2 of the ZnO grains 1 extending in a direction orthogonal to a current path contributes to varistor characteristics, a grain boundary 3 extending parallel to a current path would be unnecessary in view of enhancement of varistor characteristics. Moreover, a current flowing along a current path P1 comes across three grain boundaries, and a current flowing along a current path P2 comes across four grain boundaries. This means that an operating voltage of the varistor differs between the current paths P1, P2. Thus, a varistor operation at lower voltage can be achieved only if the number of grain boundaries is more strictly controlled.

3. Single-Grain-Boundary Varsity

It is known that each grain boundary of a zinc oxide varistor containing an appropriate additive has an operating voltage of 3 V. Thus, a low-voltage type varistor having any operating voltage of an integral multiple of 3 V can be produced by preparing a plurality of varistors each with a single grain boundary, and connecting them in series.

There has been known a single-grain-boundary varistor experimentally produced by forming a bismuth-containing oxide crystal phase intervening between zinc-oxide single crystals (see, for example, the following Non-Patent Publication 3). While this technique can achieve a current-voltage characteristic with high nonlinearity, it still involves a problem about strength of a junction between the opposed zinc-oxide single crystals. The single-grain-boundary varistor produced through a process utilizing a crystalline grain-boundary layer as disclosed in the Non-Patent Publication 3 leaves a problem about mechanical strength of a junction therein, as in the after-mentioned Comparative Examples.

There has also been known a single-grain-boundary varistor device obtained by fundamentally joining zinc-oxide single crystals together without forming an intervening crystal phase between grain boundaries (see, for example, the following Non-Patent Publications 4 and 5). While a certain level of mechanical strength is achieved in the varistor device disclosed in the Non-Patent Publication 4, the varistor device without any intervening grain-boundary layer has a poor performance, wherein an $\alpha$-value as a performance index of varistor characteristics is less than 10. Similarly, adequate varistor characteristics are not achieved in the varistor device disclosed in the Non-Patent Publication 5, due to no intervening grain-boundary layer. However, the Non-Patent Publications 4 includes a valuable suggestion that, while a nonlinear current-voltage characteristic is achieved by joining zinc-oxide single crystals each containing manganese and cobalt dissolved therein in the form of a solid solution, no nonlinear current-voltage characteristic is achieved if single crystals without addition of manganese and cobalt are joined together.

[Patent Publication 1] Japanese Patent Laid-Open Publication No. 10-270214

[Non-Patent Publication 1] M. Matsuoka, Jpn. J. Appl. Phys. 10, 736-746 (1071)

[Non-Patent Publication 2] "Evaluation of Single Grain Boundaries in ZnO: Rare-Earth Varsity by Micro-Electrodes" S. Tanaka, K. Takahashi; "Key Engineering Materials Series, Vol. 157-158, CSJ Series Vol. 1, (Electroceramics in Japan I)" p 241 (1998), (Trans Tech Publication, Switzerland)

[Non-Patent Publication 3] "MODEL EXPERIMENTS DESCRIBING THE MICRO-CONTACT OF ZnO VARIS- TORS", SCHWINGU, HOFFMANN B, JOURNAL OF APPLIED PHYSICS, 57 (12): 5372-5379 (1985)

[Non-Patent Publication 4] "Synthesis of ZnO bicrystals doped with Co or Mn and their electrical properties" Ohashi N, Terada Y, Ohgaki T, Tanaka S, Turumi T, Fukunaga O, Haneda H, Tanaka J, JAPANESE JOURNAL OF APPLIED PHYSICS PART 1-REGULAR PAPER SHORT NOTES & REVIEW PAPERS, 38 (9A): 5028-5032, SEPTEMBER (1999)

[Non-Patent Publication 5] "Current-voltage characteristic across [0001] twist boundaries in zinc oxide bicrystals" Sato Y, Oba F, Yamamoto T, Ikuhashi Y, Sakuma T, JOURNAL OF THE AMERICAN CERAMIC SOCIETY, 85 (8): 2142-2144, AUGUST (2002)

DISCLOSURE OF INVENTION

In view of the above circumstances, it is an object of the present invention to provide a single-grain-boundary varistor device or a zinc oxide resistor exhibiting varistor characteristics based on an artificial grain boundary obtained by joining zinc-oxide single crystals.

It is an another object of the present invention to provide a zinc oxide resistor structure capable of achieving an $\alpha$-value, or a performance index of a zinc oxide varistor, of about 20 or more, which is equivalent to that of a conventional typical polycrystalline varistor device, and joining zinc-oxide single crystals with a high junction strength in an obtained artificial grain boundary, so as to eliminate the risk of peeling of the zinc-oxide single crystals during use.

It is yet another object of the present invention to provide a method of producing such a zinc oxide resistor.

The present invention provides a zinc oxide varistor having varistor characteristics achieved by a structure which comprises a pair of opposed zinc-oxide single crystals each containing cobalt and manganese dissolved therein in the form of a solid solution, and a glass layer forming an oxide grain boundary layer which includes a primary component consisting of bismuth and boron and intervenes between the zinc-oxide single crystals.

The present invention provides a structure and production method for achieving zinc oxide varistor characteristics conventionally achieved in a zinc oxide sintered body, by a multilayer comprising a pair of opposed single crystals and a glass layer forming an oxide grain boundary layer. Thus, differently from a conventional varistor consisting of polycrystalline body, the technique of joining the opposed single crystals makes it possible to provide enhanced controllability of a resistor so as to obtain a varistor having an intended function.

In order to achieve the above objects, the following techniques are employed.

(A) Use of Zinc-Oxide Single Crystals each containing Cobalt and Manganese

A pair of zinc-oxide single crystals containing cobalt and manganese dissolved therein in the form of a solid solution are joined together to form a joined unit so as to provide a nonlinear current-voltage characteristic in a resistor having the joined zinc-oxide single crystals.

(B) Presence of Grain Boundary Layer containing Bismuth Oxide

Instead of simply joining the zinc-oxide single crystals, an intervening layer containing bismuth oxide is formed in the junction interface between the zinc-oxide single crystals to enhance the nonlinear current-voltage characteristic of the zinc oxide varistor.

(C) Non-Crystallization of Grain Boundary Layer containing Bismuth Oxide

If the bismuth oxide layer intervening between the grain boundaries in the joined unit of the zinc-oxide single crystals is crystallized, the mechanical strength of the joined unit is likely to be spoiled, as described above. Thus, the grain boundary layer of the joined unit is formed of a bismuth-and-boron-containing oxide glass phase. In a process of forming this glass phase, the boron oxide added to the bismuth-containing layer residing in the junction interface can accelerate vitrification of the grain boundary layer by taking advantage of its feature of a low melting point.

The zinc-oxide varistor or resistor has a current-voltage characteristic with significantly high nonlinearity, and a resistance value to be reduced in response to a high-voltage noise. Based on these features, the zinc-oxide resistor is used for protecting an electric/electronic circuit from an abnormal high voltage. The junction interface between the zinc-oxide single crystal/grain boundary layer/zinc-oxide single crystal distinctively provides significantly high nonlinearity at an operating voltage of about 3 V. Thus, differently from the conventional zinc-oxide varistor device consisting of sintered body or polycrystalline body, in the zinc-oxide resistor of the present invention, the number of interfaces defined by the structure of (zinc-oxide single crystal/grain boundary layer/zinc-oxide single crystal) can be set at a desired value. Thus, the operating voltage for noise removal can be readily adjusted.

For example, if it is necessary to protect an electric/electronic circuit which is operated at 15 V but it is not warranted against an abnormal voltage of 20 V, six of the (zinc oxide layer/grain boundary layer/zinc oxide layer) each having an operating voltage of 2.8 V can be electrically connected in series to obtain a protection circuit capable of absorbing an abnormal voltage of 2.8×6=16.8 V or more.

BEST MODE FOR CARRYING OUT THE INVENTION (1) A zinc oxide resistor of the present invention provides comprises as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals. The zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein.

Figure 1:
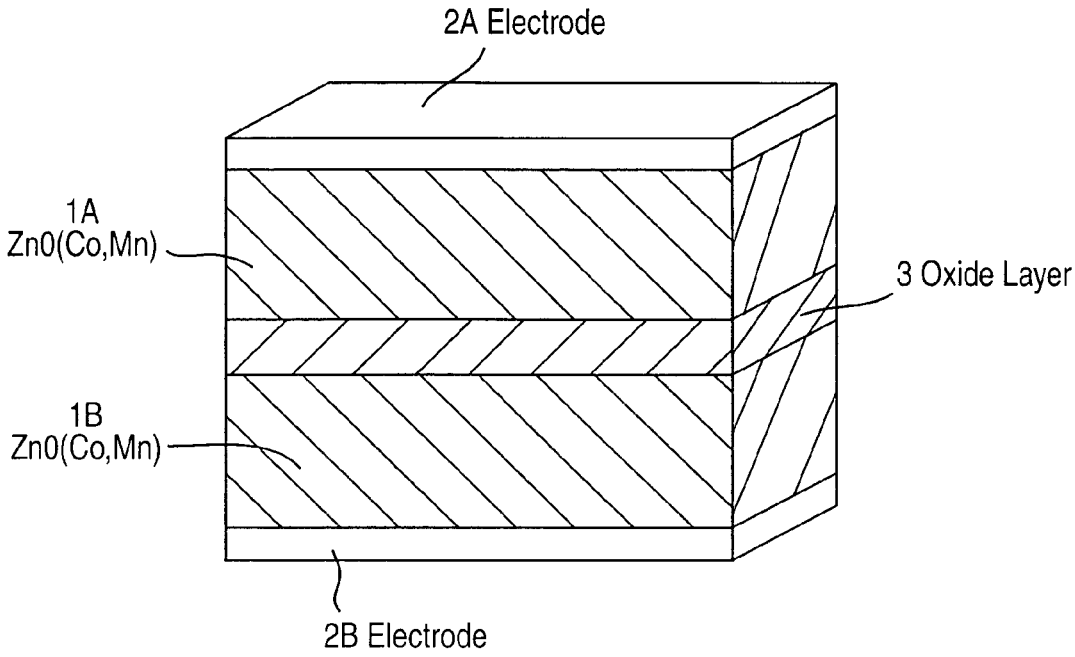
FIG. 1 is a schematic diagram of a zinc oxide resistor of the present invention, which comprises a pair of opposed zinc-oxide single crystals and an oxide glass interface layer containing bismuth and boron and intervening in the interface between the zinc-oxide single crystals.

FIG. 1 shows a nonlinear resistor which has the so-called "varistor characteristics", and a structure with only one grain boundary formed by joining a pair of opposed single crystals. Specifically, the grain boundary is formed by disposing a pair of zinc-oxide single crystals 1A, 1B each containing cobalt and manganese dissolved therein in the form of a solid solution, in opposed relation to one another between a pair of electrodes 2A, 2B. The cobalt and manganese are elements which are considered to be essential to the expression of nonlinearity, as disclosed in the aforementioned Non-Patent Publication 4.

As disclosed in the Non-Patent Publication 3, the nonlinearity can be enhanced by segregating a grain boundary layer containing bismuth, in the grain boundary. Thus, an oxide layer 3 containing bismuth is provided as an interface layer disposed between the zinc-oxide single crystals 1A, 1B. Additionally, in order to ensure a sufficient mechanical strength in the junction between the opposed zinc-oxide single crystals 1A, 1B or prevent the peeling of the opposed zinc-oxide single crystals 1A, 1B, the oxide layer 3 is formed as a glass phase containing bismuth oxide and boron oxide to provide enhanced junction strength.

When a zinc-oxide based nonlinear resistor is produced by the addition of bismuth, cobalt and manganese, an auxiliary additive, such as antimony, may be added to provide enhanced characteristics, as is generally known. While cobalt, manganese, bismuth and boron are used as additives in the zinc-oxide resistor structure of the present invention, it is to be understood that any other suitable auxiliary additive may be additionally used. The essence of the present invention lies in forming the bismuth-and-boron-containing oxide glass phase in the junction between the opposed zinc-oxide single crystals. Thus, it is not essential to the present invention whether an auxiliary additive other than cobalt and manganese is added to the opposed zinc-oxide single crystals.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (2) each of the opposed zinc-oxide single crystals may contain the cobalt dissolved therein in the form of a solid solution, in an amount of 0.5 mol % or more with respect to zinc therein.

As described above, cobalt is one essential element to the expression of nonlinearity. When it is necessary to achieve high nonlinearly in the zinc oxide resistor of the present invention having the interface layer formed as a glass phase containing a primary component consisting of bismuth and boron, each of the opposed zinc-oxide single crystals preferably contains the cobalt dissolved therein in the form of a solid solution, in an amount of 0.5 mol % or more. In an actual production process for the resistor, it is desirable that an optimal cobalt concentration for achieving intended resistor characteristics is experimentally determined while taking account of the type and concentration of each impurity originally contained in zinc-oxide single crystals to be used. In this case, the solid solubility of cobalt into zinc oxide has a given limit, and the upper limit is determined by the solid solubility of the cobalt in the zinc oxide.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (3) each of the opposed zinc-oxide single crystals may contain the manganese dissolved therein in the form of a solid solution, in an amount of 0.05 mol % or more with respect to zinc therein.

The addition of manganese can bring about an effect of reducing a leak current due to the grain boundary to provide enhanced nonlinearity.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (4) each of the opposed zinc-oxide single crystals may have a length of 5 mm, a width of 5 mm, and a thickness of 0.5 mm, and the oxide containing a primary component consisting of bismuth and boron, to be used for forming a junction between the opposed zinc-oxide single crystals, may be a glass prepared in such a manner as to contain, in oxide wt % equivalent, 37.0 to 22.7 wt % of $B_2O_3$, 3.8 to 1.9 wt % of $Co_2O_3$ and 5.7 to 1.6 wt % of $MnO_2$, with the remainder being bismuth oxide.

The above composition of the interface layer is effective in producing the zinc oxide resistor using zinc-oxide single crystals prepared by cutting a commercially-available zinc-oxide single crystal having a typical thickness of 0.5 mm, into a size of 5×5 mm, to achieve excellent junction and nonlinearity. The present invention is not limited to the above composition, but any other suitable composition may be appropriately selected depending on the thickness of each zinc-oxide single crystal to be used, the type and quantity of element originally dissolved in the zinc-oxide single crystals to be joined, in the form of a solid solution, resistance characteristics required for the joined unit, and other factors. In the same manner, a temperature and/or time-period in the process of forming the junction may also be appropriately selected.

The above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (5) may exhibit an $\alpha$-value of 20 or more, as a performance index of a zinc oxide varistor.

Specifically, the zinc oxide resistor has the opposed zinc-oxide single crystals containing the cobalt and manganese dissolved therein in a solid solution, and the grain boundary layer having the bismuth-and-boron-containing oxide glass phase and intervening in the joined unit. Particularly, based on this structure, the zinc oxide resistor exhibits an $\alpha$-value of 20 or more, as a performance index of a zinc oxide varistor.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (6) the (zinc-oxide single crystal/bismuth-boron based oxide interface layer/zinc-oxide single crystal) structure serving as the basic unit may have an operating voltage of 2.9±0.3 V, as a performance index of a zinc oxide varistor.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (7) the (zinc-oxide single crystal/bismuth-boron based oxide interface layer/zinc-oxide single crystal) structure may be provided in a number of n. In this case, the structures of the number n may be repeatedly superimposed in a layered manner, and provided with a zinc-oxide single crystal superimposed thereon to form a (n+1) layered structure including the number (n+1) of zinc-oxide single crystals and the number n of bismuth-boron based oxide interface layers. The zinc-oxide resistor has an operating voltage of (2.9±0.3) n V, as a performance index of a zinc oxide varistor.

Figure 2:
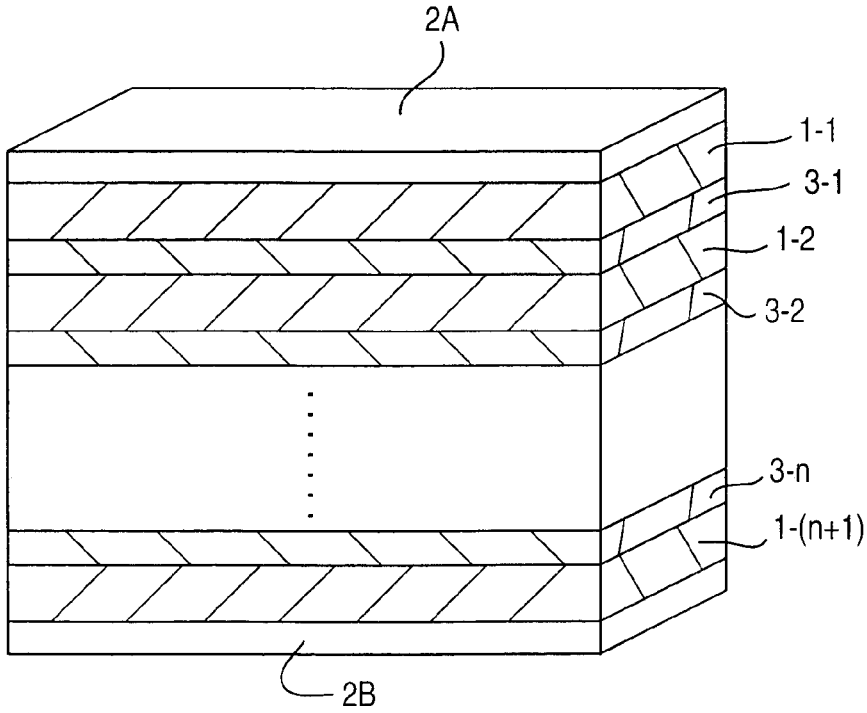
FIG. 2 is a schematic diagram of a zinc-oxide resistor device with a controlled operating voltage, produced by superimposing in a parallel arrangement the plurality of zinc oxide resistors of the present invention, which comprises a pair of opposed zinc-oxide single crystals and an oxide glass interface layer containing bismuth and boron and intervening between the zinc-oxide single crystals.

Specifically, the operating voltage of 2.9±0.3 V is achieved by a single junction, and the structures of the number n can be superimposed in a layered manner as shown in FIG. 2 to provide a multilayer zinc oxide resistor having any desired operating voltage.

In the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, (8) the (zinc-oxide single crystal/bismuth-boron based oxide interface layer/zinc-oxide single crystal) structure may be adjusted to have an operating voltage of x V, as a performance index of a zinc oxide varistor, and provided in a number of n. In this case, the structures of number n may be electrically connected in series. The zinc-oxide resistor has an operation voltage of n×x V, as a performance index of a zinc oxide varistor.

Figure 3:
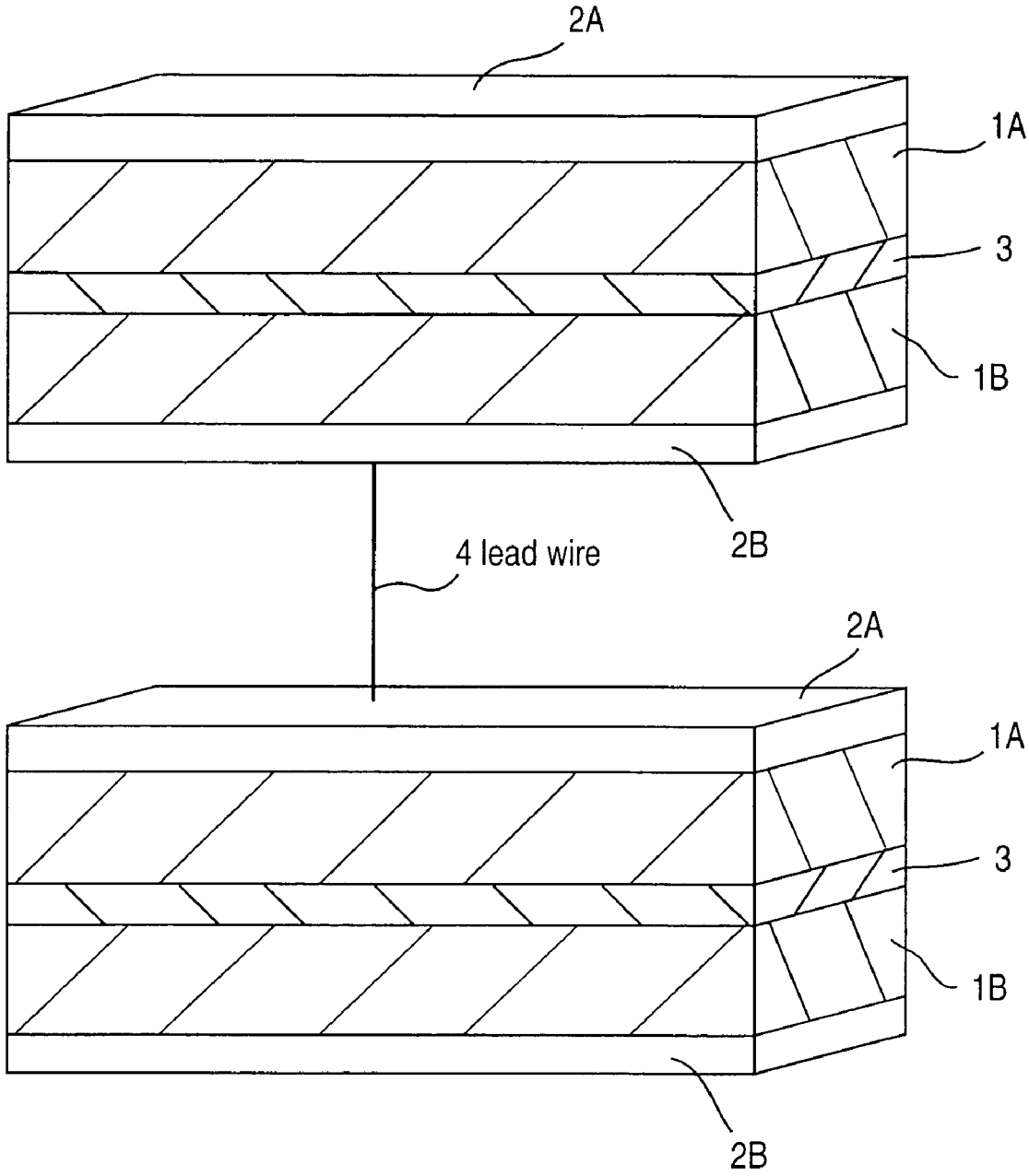
FIG. 3 is a schematic diagram of a zinc-oxide resistor device with a controlled operating voltage, produced by connecting in series the plurality of zinc oxide resistors of the present invention, which comprises a pair of opposed zinc-oxide single crystals and an oxide glass interface layer containing bismuth and boron and intervening in the interface between the zinc-oxide single crystals.

Specifically, the operating voltage of 2.9±0.3 V is achieved by a single junction, and the structures of the number n can be electrically connected to each other using lead wires as shown in FIG. 3 to provide a series-connected zinc oxide resistor having any desired operating voltage.

(9) A method of producing either one of the above zinc oxide resistors (1) to (7) of the present invention, comprises: disposing an oxide containing bismuth and boron, between a pair of opposed zinc-oxide single crystals to form a sandwich structure of (a zinc-oxide single crystal/a composition to be formed as a glass phase/a zinc-oxide single crystal); heating and holding the sandwich structure at a high temperature allowing the oxide containing bismuth and boron, to be molten; and rapidly cooling the heated sandwich structure to join the pair of zinc-oxide single crystals with a glass-phase oxide interface layer intervening therebetween.

Figure 4:
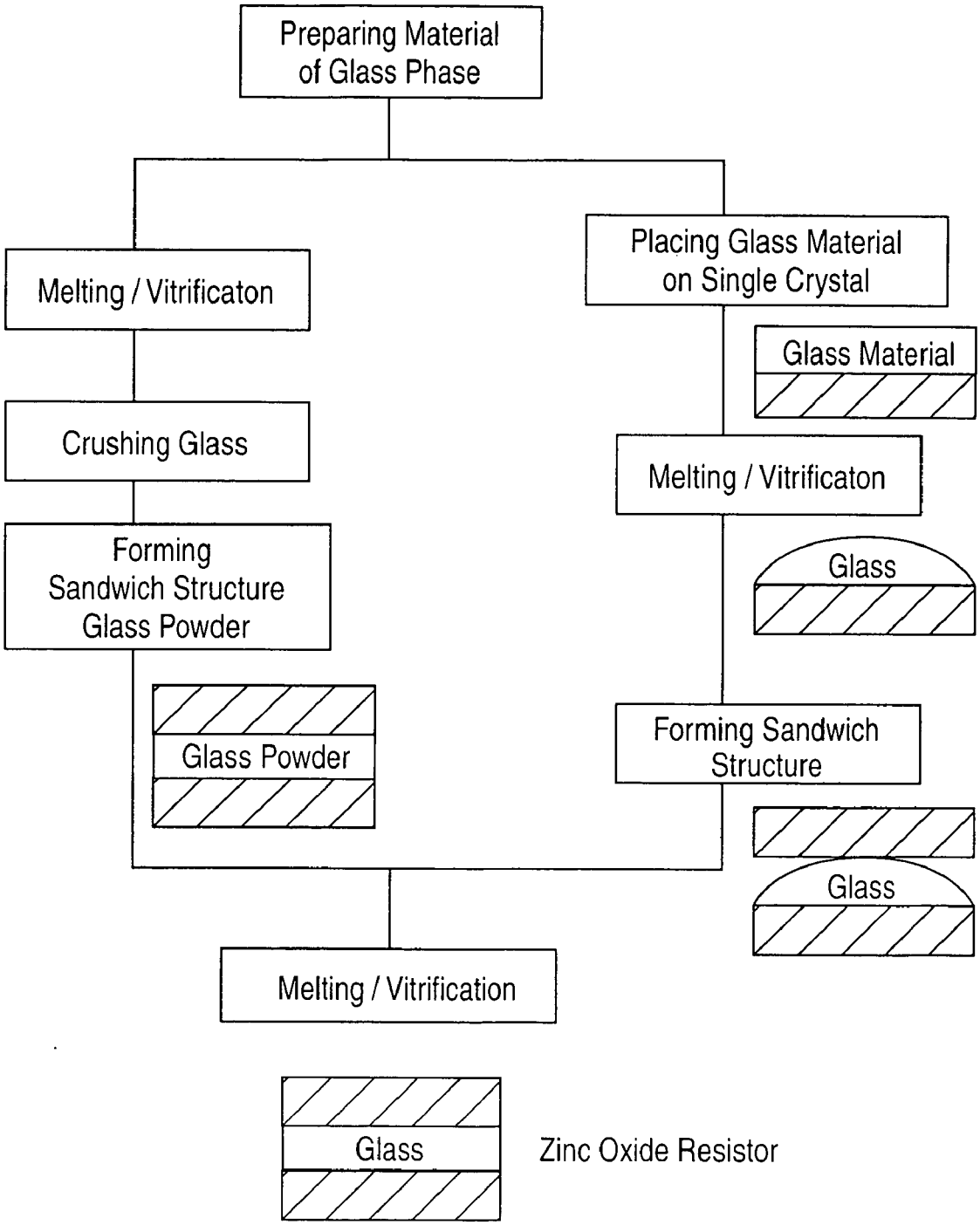
FIG. 4 is an exemplary process diagram for producing the zinc oxide resistor of the present invention, which comprises a pair of opposed zinc-oxide single crystals and an oxide glass interface layer containing bismuth and boron and intervening in the interface between the zinc-oxide single crystals.

In this method, a process of disposing the bismuth-and-boron-containing oxide between the opposed zinc-oxide single crystals, to form the sandwich structure of (a zinc-oxide single crystal/a composition to be formed as a glass phase/a zinc-oxide single crystal), includes a plurality of options. FIG. 4 shows this process. In one of the options, a suitable material for forming a desired glass phase is molten and vitrified in advance using a crucible, such as a platinum crucible, and then crushed to obtain a glass powder. In another option, a composition to be formed as a desired glass phase is placed on one zinc-oxide single crystal to be joined, and the zinc-oxide single crystal is used as a plate for vitrification without using a crucible. In the former case, the obtained glass phase is disposed between a pair of zinc-oxide single crystals to be joined, and then they are subjected to a heat treatment to form a junction between the zinc-oxide single crystals. In the latter case, another zinc-oxide single crystal is disposed in opposed relation to the zinc-oxide single crystal having the vitrified composition attached thereon, and they are subjected to a heat treatment to form a junction between the zinc-oxide single crystals.

In this process, a time-period of the heat treatment for heating the sandwich structure at a high temperature to melt the glass and form the junction is not limited to a specific value. While the heat-treatment time is required to set at a sufficient value for allowing the glass to be homogenized, an excessive heat-treatment time induces a reaction between the glass components and the zinc-oxide single crystals to cause elution of zinc oxide into the glass components. Thus, it is practically desirable to prepare a glass powder in advance as in the former case, and, after heating the glass powder at a high temperature allowing the glass to be molten, for a melting time of about 3 to 12 hours, rapidly cool the glass.

In either case, it is desirable to optimize the composition of the glass phase in consideration of wettability to zinc oxide so as to obtain the aforementioned required structure of the zinc oxide resistor. For example, the glass composition is preferably determined by synthesizing a glass phase containing bismuth and boron, melting and rapidly cooling the glass on the zinc-oxide single crystal to form a joined unit of zinc oxide and glass droplets, calculating a contact angle between the glass and the zinc-oxide single crystal based on this joined unit, selecting a glass allowing the contact angle to be 5 degrees or less.

In the above production method, it is not specified whether cobalt and manganese are added to the glass. If each of the zinc-oxide single crystals to be joined has a thin-plate shape, cobalt and manganese may be added in advance to glass components to be formed as the grain boundary of the joined unit, and diffused in the zinc-oxide single crystals in conjunction with the process of subjecting the sandwich structure to a heat treatment at a high temperature to melt the glass and form the junction.

If each of the zinc-oxide single crystals to be joined has a thick-plate shape, the heat treatment time for forming the junction is likely to cause insufficient diffusion of the cobalt and manganese from the molten glass to the zinc oxide. Thus, irrelevant to each thickness of the zinc-oxide single crystals, the above production method is preferably implemented in such a manner that a pair of zinc-oxide single crystals each containing cobalt and manganese diffused therein in advance is used together with the glass components to formed the sandwich structure, and then the sandwich structure is subjected to a heat treatment at a high temperature to form the junction.

The above production method is only one typical example. Thus, any other suitable method may be used to produce the above zinc oxide resistor comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein. That is, the above zinc oxide resistor of the present invention comprising as a basic unit a structure of (a zinc-oxide single crystal/a bismuth-boron based oxide interface layer/a zinc-oxide single crystal) formed of a pair of opposed zinc-oxide single crystals each containing cobalt and manganese dissolved therein in the form of a solid solution, and an oxide which contains a primary component consisting of bismuth and boron and intervenes between the zinc-oxide single crystals, wherein the zinc oxide resistor has non-ohmic properties or exhibits zinc-oxide varistor characteristics, based on the intervening oxide interface layer, and the bismuth-boron based oxide interface layer is formed as a bismuth-and-boron-containing oxide glass phase by the action of the boron contained therein, is not limited by a production method thereof.

(10) A method of producing either one of the above zinc oxide resistors (1) to (7) of the present invention, comprises: bringing each of two zinc-oxide single crystals into contact with a chunk of oxide cobalt, and heating the zinc-oxide single crystals and the chunk of oxide cobalt at a high temperature capable of inducing a diffusion reaction to diffuse cobalt from the chunk of oxide cobalt into the zinc-oxide single crystals so as to prepare a pair of zinc-oxide single crystals in such a manner as to have a cobalt concentration of 0.5 mol % or more; disposing an oxide containing bismuth and boron, between the pair of zinc-oxide single crystals disposed opposed to one another, to form a sandwich structure of (a zinc-oxide single crystal/a composition to be formed as a glass phase/a zinc-oxide single crystal); heating and holding the sandwich structure at a high temperature allowing the bismuth-and-boron-containing oxide to be molten; and rapidly cooling the heated sandwich structure to join the pair of zinc-oxide single crystals with a glass-phase oxide interface layer intervening therebetween.

Specifically, in order to obtain enhanced characteristics in the zinc oxide resistor through the production method of the present invention, it is required to adjust the concentration of cobalt in the zinc-oxide single crystals to be joined, at a desired value. Thus, if a commercially-available zinc-oxide single crystal containing no cobalt, it is necessary to introduce an appropriate amount of cobalt into the single crystal. In this process of introducing cobalt, it is desirable to introduce a high concentration of cobalt without roughening the surface of the zinc-oxide single crystal.

For this purpose, cobalt can be conveniently introduced into a zinc-oxide single crystal by preparing a chunk containing a primary component consisting of oxide cobalt, bringing the chunk of oxide cobalt into contact with a target zinc-oxide single crystal, and heating and holding them at a high temperature. A measurement based on light absorption spectrum may be conveniently used for determining a quantity of cobalt to be introduced, in a nondestructive manner. In this case, an analytical curve may be made in advance to calculate a quantity of cobalt to be added, based on light absorption spectrum.

(11) In the production method (9) or (10) of the present invention, when each of the opposed zinc-oxide single crystals has a length of 5 mm, a width of 5 mm, and a thickness of 0.5 mm, the oxide containing a primary component consisting of bismuth and boron, to be used for forming a junction between the opposed zinc-oxide single crystals, may be a glass prepared in such a manner as to contain, in oxide wt % equivalent, 37.0 to 22.7 wt % of $B_2O_3$, 3.8 to 1.9 wt % of $Co_2O_3$ and 5.7 to 1.6 wt % of $MnO_2$, with the remainder being bismuth oxide.

Specifically, each optimal quantity of cobalt, manganese, bismuth and boron to be contained in the glass phase differs depending on each size of the opposed zinc-oxide single crystals to be joined, and the type and quantity of additives originally containing therein. Thus, the above composition is simply shown as one example capable of producing a nonlinear resistor using the zinc-oxide single crystals each having a length of 5 mm, a width of 5 mm, and a thickness of 0.5 mm. Therefore, the above composition is not always an applicable value to all of zinc oxide resistors having the interface layer formed as a bismuth-and-boron-containing oxide glass phase according to the present invention.

(12) In either one of the production methods (9) to (11) of the present invention, the oxide containing a primary component consisting of bismuth and boron, to be used for forming a junction between the opposed zinc-oxide single crystals, may be a glass. In this case, the method may include flattening each surface of the opposed zinc-oxide single crystals through mirror polishing, and adjusting a quantity of the glass in such a manner that a molar ratio of the glass quantity in an equivalent bismuth quantity contained in the glass to a quantity of the opposed zinc-oxide single crystals, is set at 1.2 mol %.

This total quantity of the glass phase for forming the junction simply shows a desirable value in one case where each surface of the opposed zinc-oxide single crystals is flatted through mirror polishing. Fundamentally, it is desirable that the total quantity of the glass phase for forming the junction is optimized in consideration of each flatness or surface area of the opposed zinc-oxide single crystals to be joined. Thus, in advance of an actual production, it is desirable to determine an optimal amount of bismuth with reference to the above recommended value.

EXAMPLE

Inventive Example 1

Each of two zinc-oxide single crystals was in contact with a cobalt-oxide sintered body, in an oxygen flow at 1200° C. for 3 hours to diffuse cobalt into each zinc-oxide single crystal so as to prepare two cobalt-doped zinc-oxide single crystals. A quantity of the resulting solid solution of cobalt was calculated as about 1 at % based on optical spectrum. Then, 0.8772 g of boron oxide, 8.8068 g of bismuth oxide, 0.1517 g of cobalt oxide and 0.16431 g of manganese oxide were measured and mixed together. The obtained mixture was put in a platinum crucible, and molten at 900° C. in an oxygen flow. Then, the molten mixture was flowed out of the crucible, and solidified to obtain a bismuth-and-boron-containing oxide glass. After crushing the glass, the obtained glass powder was dredged on one of the prepared cobalt-doped zinc-oxide single crystals (5×5×0.5 mm), and another zinc-oxide single crystal was superimposed on the single crystal with the glass powder to form a sandwich structure.

Figure 5:
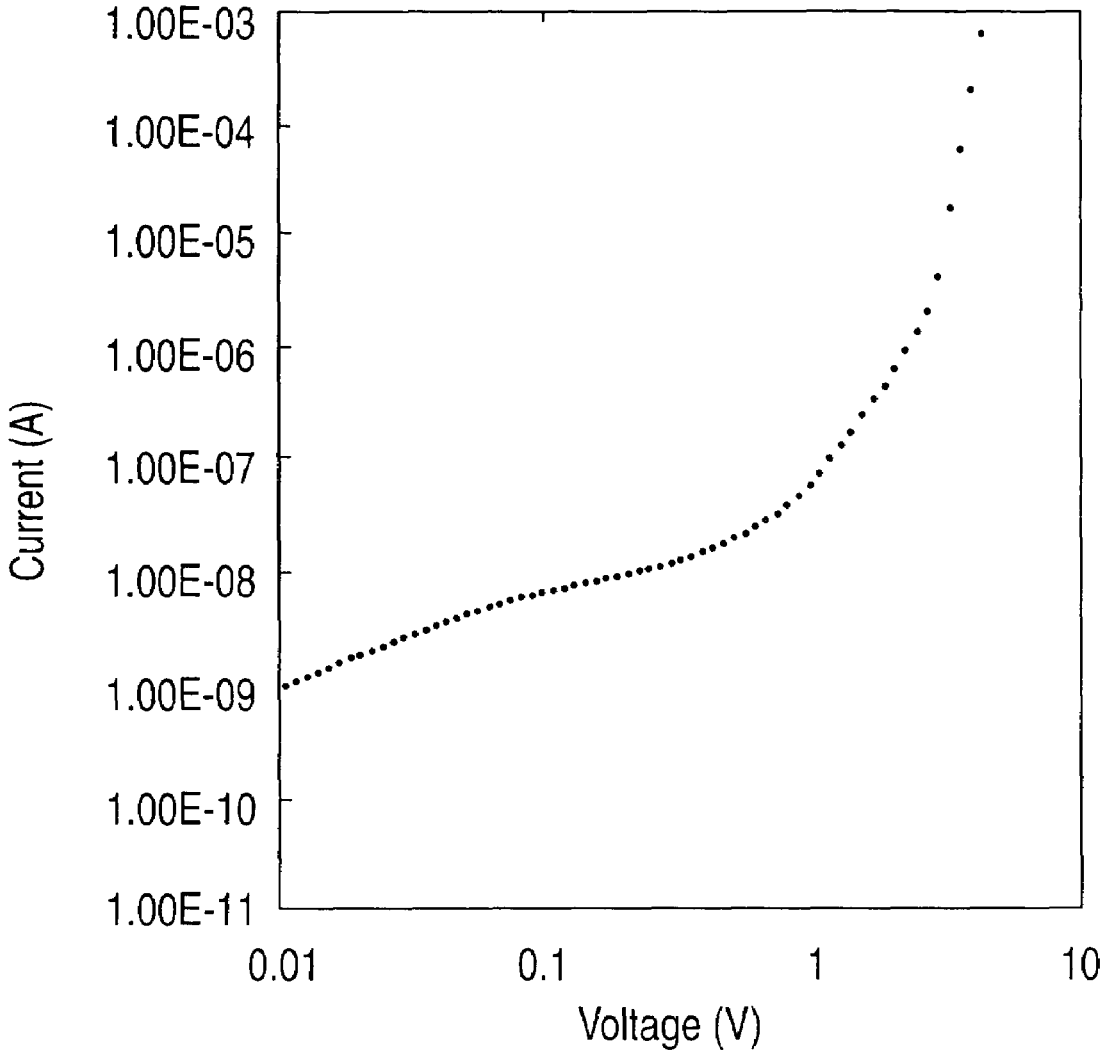
FIG. 5 is a graph showing a current-voltage characteristic at room temperature of a zinc oxide resistor obtained in Inventive Example 1.

Without particular pressing, the sandwich structure was heated at 1000° C. in an oxygen flow for 12 hours, and then cooled to room temperature over a period of about 5 hours to produce a zinc oxide resistor. The manganese was dissolved in the zinc-oxide single crystals through diffusion. As shown in FIG. 5, the obtained zinc oxide resistor exhibited a current-voltage characteristic represented by $\alpha$=20.

Inventive Example 2

Each of two zinc-oxide single crystals was in contact with a cobalt-oxide sintered body, in an oxygen flow at 1200° C. for 12 hours to diffuse cobalt into each zinc-oxide single crystal so as to prepare two cobalt-doped zinc-oxide single crystals. Then, 0.8772 g of boron oxide, 8.8068 g of bismuth oxide, 0.1517 g of cobalt oxide and 0.16431 g of manganese oxide were measured and mixed together. The obtained mixture was put in a platinum crucible, and molten at 900° C. in an oxygen flow. Then, the molten mixture was flowed out of the crucible, and solidified to obtain a bismuth-and-boron-containing oxide glass. After crushing the glass, the obtained glass powder was dredged on one of the prepared cobalt-doped zinc-oxide single crystals (5×5×0.5 mm), and another zinc-oxide single crystal was superimposed on the single crystal with the glass powder to form a sandwich structure.

Figure 6:
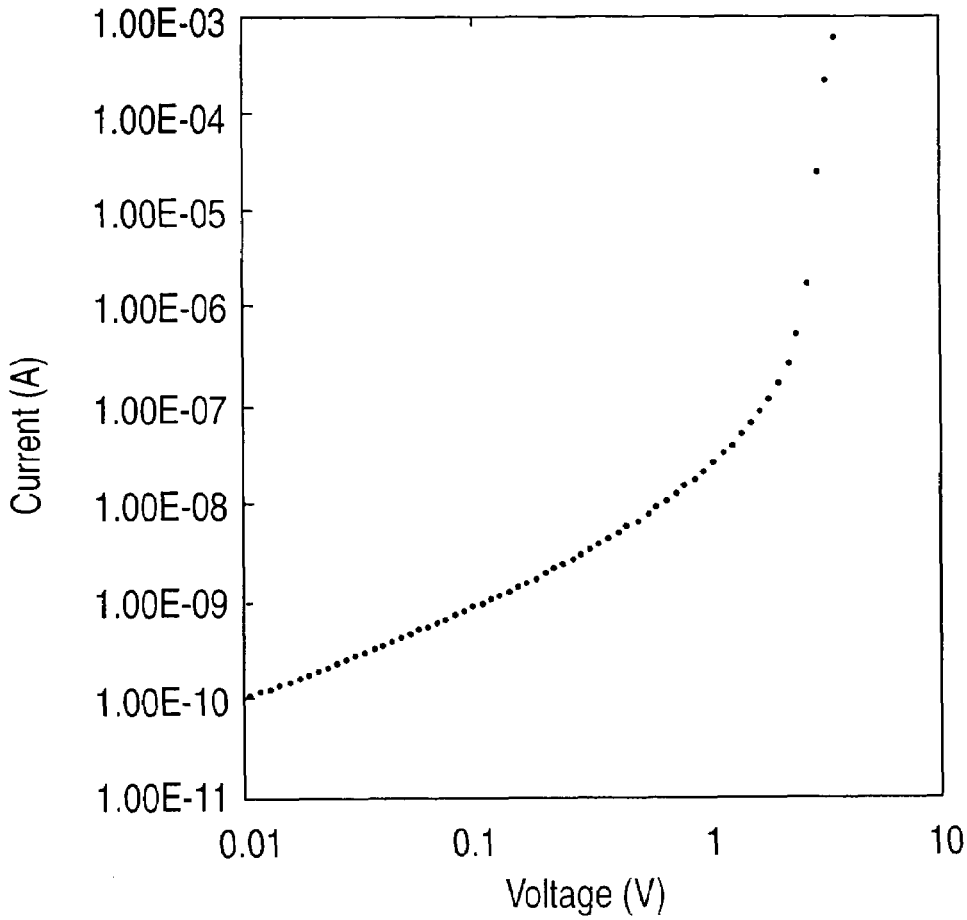
FIG. 6 is a graph showing a current-voltage characteristic at room temperature of a zinc oxide resistor obtained in Inventive Example 2.
Figure 7:
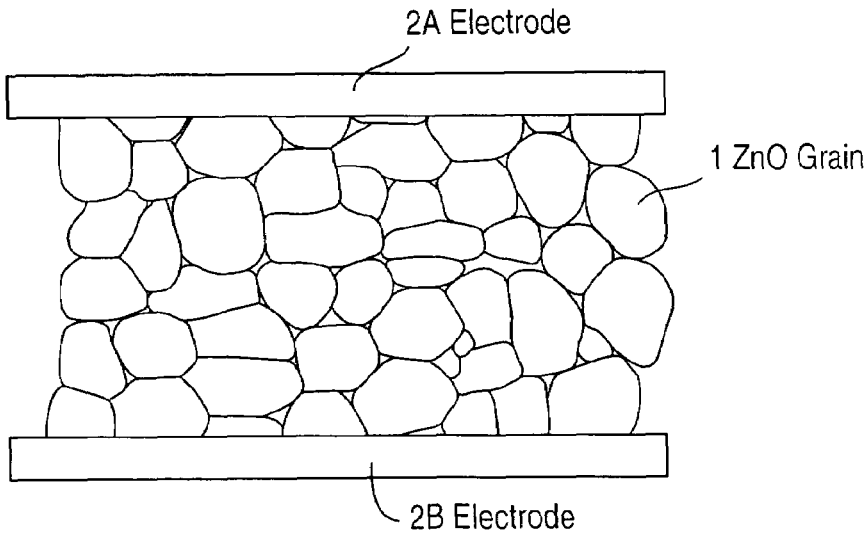
FIG. 7 is a schematic diagram of a conventional zinc oxide varistor.
Figure 8A:
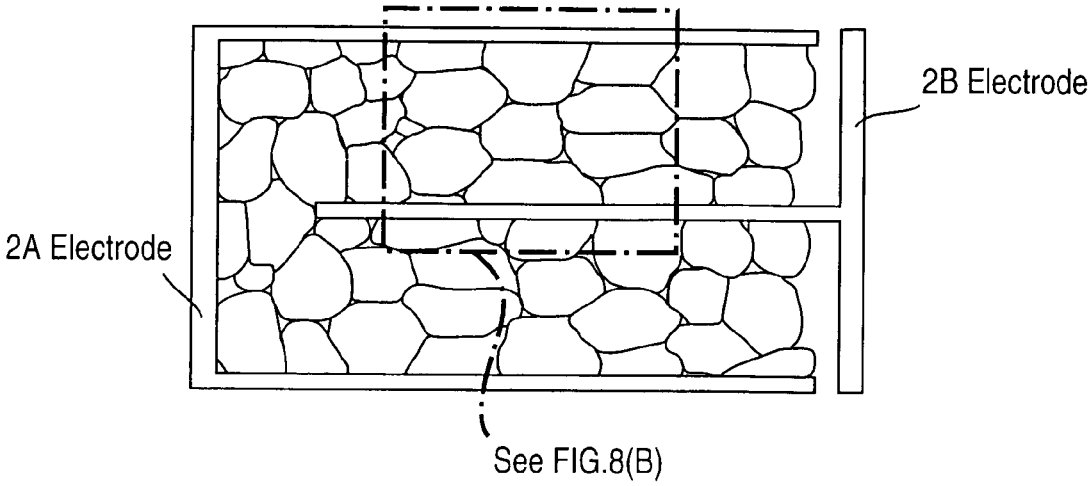
FIG. 8 is a schematic diagram of a conventional multilayer zinc oxide varistor.
Figure 8B:
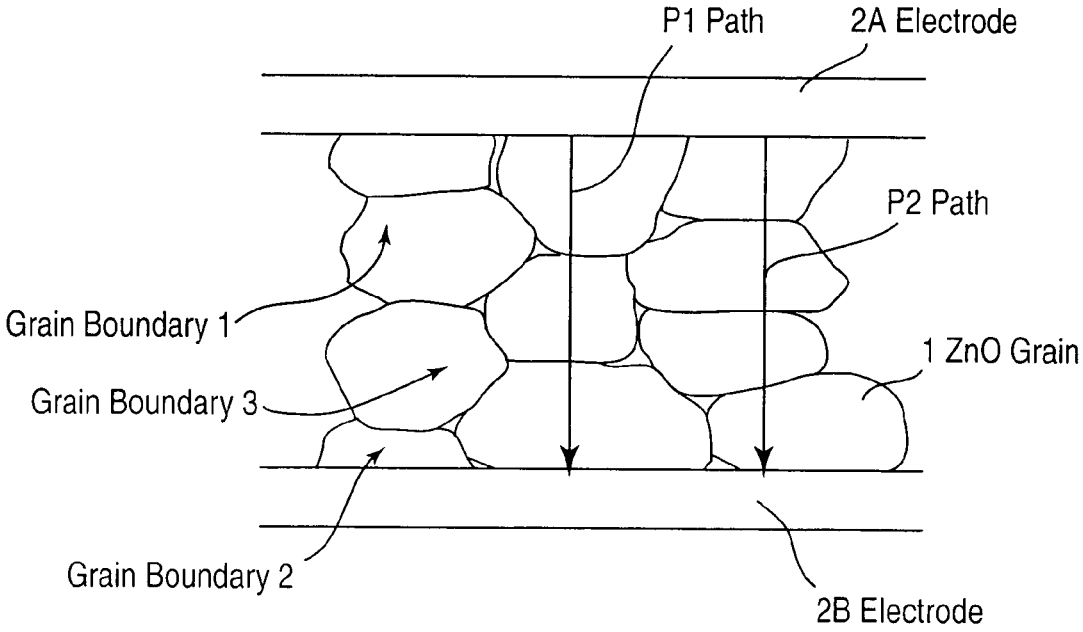

Without particular pressing, the sandwich structure was heated at 1000° C. in an oxygen flow for 4 hours, and then cooled to room temperature over a period of about 5 hours to produce a zinc oxide resistor. The manganese was dissolved in the zinc-oxide single crystals through diffusion. As shown in FIG. 6, the obtained zinc oxide resistor exhibited a current-voltage characteristic represented by $\alpha$=26.

Comparative Example 1

9.5762 g of bismuth oxide, 0.2749 g of cobalt oxide and 0.1489 g of manganese oxide were measured and mixed together. The obtained mixture was put in a platinum crucible, and molten at 900° C. in an oxygen flow. Then, the molten mixture was flowed out of the crucible, and solidified to obtain a bismuth-containing oxide glass without boron. Through x-ray diffraction measurement, it was proven that the obtained oxide is a crystal phase. After crushing the bismuth-containing oxide glass, the obtained glass powder was dredged on one of two cobalt-doped zinc-oxide single crystals (5×5×0.5 mm) prepared in advance, and another zinc-oxide single crystal was superimposed on the single crystal with the glass powder to form a sandwich structure.

Without particular pressing, the sandwich structure was heated at 1000° C. in an oxygen flow for 1 hour, and then cooled to room temperature over a period of about 5 hours to produce a zinc oxide resistor. While a measurement about characteristics was attempted in the same manner as that in Incentive Examples 1 and 2, the zinc-oxide single crystals was peeled from one another during the measurement due to poor junction strength. The reason would be that the interface layer is formed as polycrystal due to no addition of boron into the interface layer, and consequently grain boundaries and/or cracks are formed in the interface layer to cause deterioration in mechanical strength.

Comparative Example 2

0.6018 g of boron oxide and 9.3982 g of bismuth oxide were measured and mixed together. The obtained mixture was put in a platinum crucible, and molten at 900° C. in an oxygen flow. Then, the molten mixture was flowed out of the crucible, and solidified to obtain a bismuth-and-boron-containing oxide glass. After crushing the bismuth-and-boron-containing oxide glass, the obtained glass powder was dredged on one of two cobalt-doped zinc-oxide single crystals (5×5×0.5 mm) prepared in advance without a cobalt diffusion treatment, and another zinc-oxide single crystal was superimposed on the single crystal with the glass powder to form a sandwich structure.

Without particular pressing, the sandwich structure was heated at 1000° C. in an oxygen flow for 4 hours, and then cooled to room temperature over a period of about 5 hours to produce a zinc oxide resistor. While a measurement about characteristics was attempted in the same manner as that in Incentive Examples 1 and 2, a linear current-voltage characteristic was obtained without any observation of a non-linear current-voltage characteristic

INDUSTRIAL APPLICABILITY

Differently from a high-voltage varistor as typified by arrestors, the zinc oxide resistor of the present invention is applicable to a low-voltage varistor, and usable in removing low-voltage noises in electronic components.

What is claimed is:

1. A zinc oxide resistor comprising:

a pair of opposed zinc-oxide single crystals each containing cobalt and manganese dissolved therein in the form of a solid solution, and a bismuth-boron based oxide interface layer intervening between said zinc-oxide single crystals, wherein said zinc oxide resistor has non-ohmic properties or exhibits zinc-oxide varistor characteristics, and said bismuth-boron based oxide interface layer includes a bismuth-and-boron-containing oxide glass phase.

2. The zinc oxide resistor as defined in claim 1, wherein each of said opposed zinc-oxide single crystals contains said cobalt dissolved therein in the form of a solid solution, in an amount of 0.5 mol % or more with respect to zinc therein.

3. The zinc oxide resistor as defined in claim 1, wherein each of said opposed zinc-oxide single crystals contains said manganese dissolved therein in the form of a solid solution, in an amount of 0.05 mol % or more with respect to zinc therein.

4. The zinc oxide resistor as defined in claim 1, wherein:

each of the opposed zinc-oxide single crystals has a length of 5 mm, a width of 5 mm, and a thickness of 0.5 mm;

said bismuth-boron based oxide interface layer comprises, in oxide wt % equivalent, 37.0 to 22.7 wt % of $B_2O_3$, 3.8 to 1.9 wt % of $Co_2O_3$ and 5.7 to 1.6 wt % of $MnO_2$, with the remainder being bismuth oxide.

5. The zinc oxide resistor as defined in claim 1, which exhibits an α-value of 20 or more, as a performance index of a zinc oxide varistor.

6. The zinc oxide resistor as defined in claim 1, wherein said zinc oxide resistor has an operating voltage of 2.9±0.3 V, as a performance index of a zinc oxide varistor.

7. The zinc oxide resistor as defined in claim 1, wherein (n+1) of zinc-oxide single crystals and (n) of bismuth-boron based oxide interface layer are alternately stacked, where n is a natural number of 2 or more, and wherein said zinc-oxide resistor has an operating voltage of (2.9±0.3) n V, as a performance index of a zinc oxide varistor.

8. The zinc oxide resistor as defined in claim 1, wherein said zinc oxide resistor has an operating voltage of x V, as a performance index of a zinc oxide varistor, wherein n of zinc oxide resistors are electrically connected in series, where n is a natural number of 2 or more, wherein said zinc-oxide resistor has an operation voltage of n ×x V, as a performance index of a zinc oxide varistor.

9. A method of producing the zinc oxide resistor as defined in claim 1, comprising:

disposing an oxide containing bismuth and boron, between a pair of opposed zinc-oxide single crystals to form a sandwich structure of (a zinc-oxide single crystal/a composition to be formed as a glass phase/a zinc-oxide single crystal);

heating and holding said sandwich structure at a high temperature allowing said oxide containing bismuth and boron, to be molten; and rapidly cooling said heated sandwich structure to join said pair of zinc-oxide single crystals with a glass-phase oxide interface layer intervening therebetween.

10. The method as defined in claim 9, includes:

bringing each of two zinc-oxide single crystals into contact with a chunk of oxide cobalt, and heating said zinc-oxide single crystals and said chunk of oxide cobalt at a high temperature capable of inducing a diffusion reaction to diffuse cobalt from said chunk of oxide cobalt into said zinc-oxide single crystals so as to prepare each of said opposed zinc-oxide single crystals in such a manner as to have a cobalt concentration of 0.5 mol % or more.

11. The method as defined in claim 9, wherein:

each of the opposed zinc-oxide single crystals has a length of 5 mm, a width of 5 mm, and a thickness of 0.5 mm;

said oxide containing a primary component consisting of bismuth and boron, to be used for forming a junction between said opposed zinc-oxide single crystals, is a glass prepared in such a manner as to contain, in oxide wt % equivalent, 37.0 to 22.7 wt % of $B_2O_3$, 3.8 to 1.9 wt % of $Co_2O3$ and 5.7 to 1.6 wt % of $MnO_2$, with the remainder being bismuth oxide.

12. The method as defined in claim 9, wherein said oxide containing a primary component consisting of bismuth and boron, to be used for forming a junction between said opposed zinc-oxide single crystals, is a glass, wherein said method includes:

flattening each surface of said opposed zinc-oxide single crystals through mirror polishing; and adjusting a quantity of said glass in such a manner that a molar ratio of said glass quantity in an equivalent bismuth quantity contained in said glass to a quantity of said opposed zinc-oxide single crystals, is set at 1.2 mol %.

* * * * *